US006383083B1

(12) United States Patent
Johnston

(10) Patent No.: US 6,383,083 B1
(45) Date of Patent: May 7, 2002

(54) PIVOTING UPLIFT APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 0 days.

(21) Appl. No.: 09/617,334

(22) Filed: Jul. 17, 2000

(51) Int. Cl.[7] ..... A61G 11/00

(52) U.S. Cl. ..... 472/106; 472/108; 482/97; 482/906

(58) Field of Search ..... 471/106, 108, 471/112, 120; 482/106, 95, 96, 72, 97

(56) References Cited

U.S. PATENT DOCUMENTS 3,311,373 A * 3/1967 Phillips ..... 472/108
4,032,138 A * 6/1977 Willis ..... 473/106
5,547,443 A * 8/1996 Chen ..... 482/72
5,885,163 A * 3/1999 Bjorn et al. ..... 472/5

* cited by examiner

*Primary Examiner*—Kien T. Nguyen

(57) ABSTRACT

A pivoting uplift apparatus is provided which enables the user to utilize the device as a piece of playground or backyard play equipment commonly known as a see-saw. The apparatus includes a frame structure means, a user support means, and a user engagement means. The user support means pivotally mounts to the frame structure means, while the user engagement means pivotally mounts to the user support means. The apparatus is different from the more conventional see-saw apparatuses in that the upward and downward pivoting motion of the user is produced by rocking the user engagement means backward and forward, not by pushing against the ground with the feet of the users. The apparatus may be configured so that rocking the user engagement means backward and forward may produce different seat movement. The apparatus may also take the form of a single user see-saw and an exercise machine, with an optional weight support member for weighing down one side.

10 Claims, 16 Drawing Sheets

PIVOTING UPLIFT APPARATUS

BACKGROUND OF THE INVENTION

This invention relates to a pivoting uplift apparatus which has an upright structure that allows the user to uplift themselves while in a seated position. The pivoting motion of the user allows the device to be used as a piece of playground or backyard equipment, or as a piece of exercise equipment.

SUMMARY AND OBJECTS OF THE INVENTION

It is the object of this invention to provide a pivoting uplift apparatus which may be used as a piece of playground equipment more commonly known as a see-saw. The main purpose of this application is to demonstrate an apparatus which may perform the stated function, and to demonstrate the many options and configurations this apparatus may take on.

Briefly stated, the apparatus that forms the basis of the present inventions comprises a frame structure means, a user support means, and a user engagement means. The user support means pivotally mounts on the frame structure means, while the user engagement means pivotally mounts upon the user support means. Optional items will include a weight support, which may be used when the device is used as a single user see-saw or as an exercise product.

The design of the apparatus is such that the user support means pivots upward and downward upon the frame structure means, and the user engagement means pivots backward and forward upon the user support means. The user sits in a seat member and pivots the user engagement means. The user engagement means is operatively connected to the frame structure means in such a manner that pivoting the user engagement means in one direction cause the seat member to pivot upward, while pivoting the user engagement means in the opposite direction causes the seat member to pivot downward. The device may have two seat members which allows two people to use the device at the same time. The user engagement means may be designed in such a manner that the two users experience the same type of motion simultaneously, but in opposite directions. Other objects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since it is capable of other embodiments and of being practiced or carried out in various ways. Also, it is to be understood that the phraseology and terminology employed herein is for the purpose of description, and not limitation.

Figure 1A:
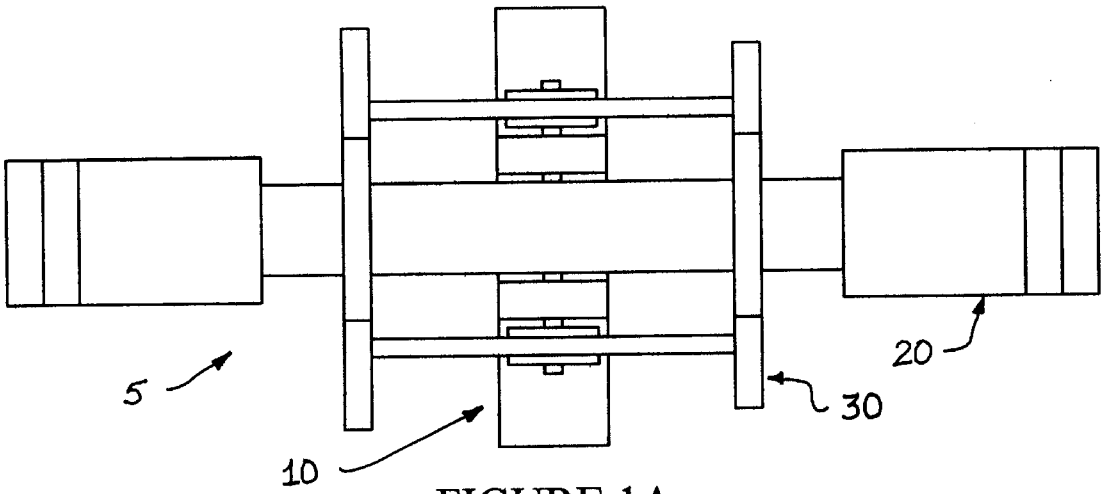
FIG. 1A is a top view of the pivoting uplift apparatus.
Figure 1B:
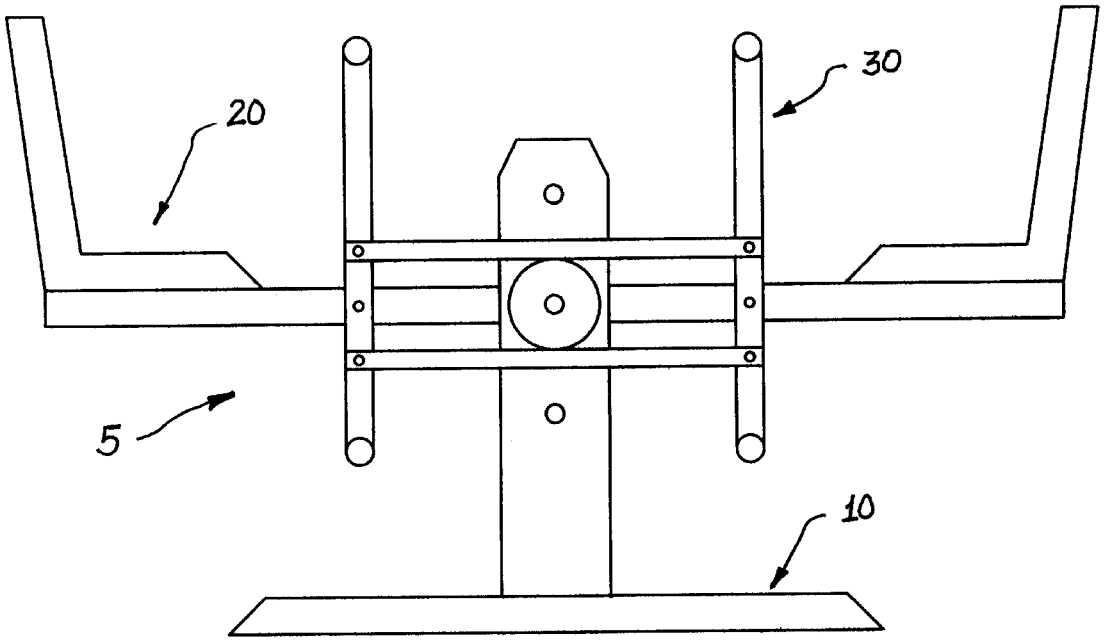
FIG. 1B is a front view of the pivoting uplift apparatus.
Figure 1C:
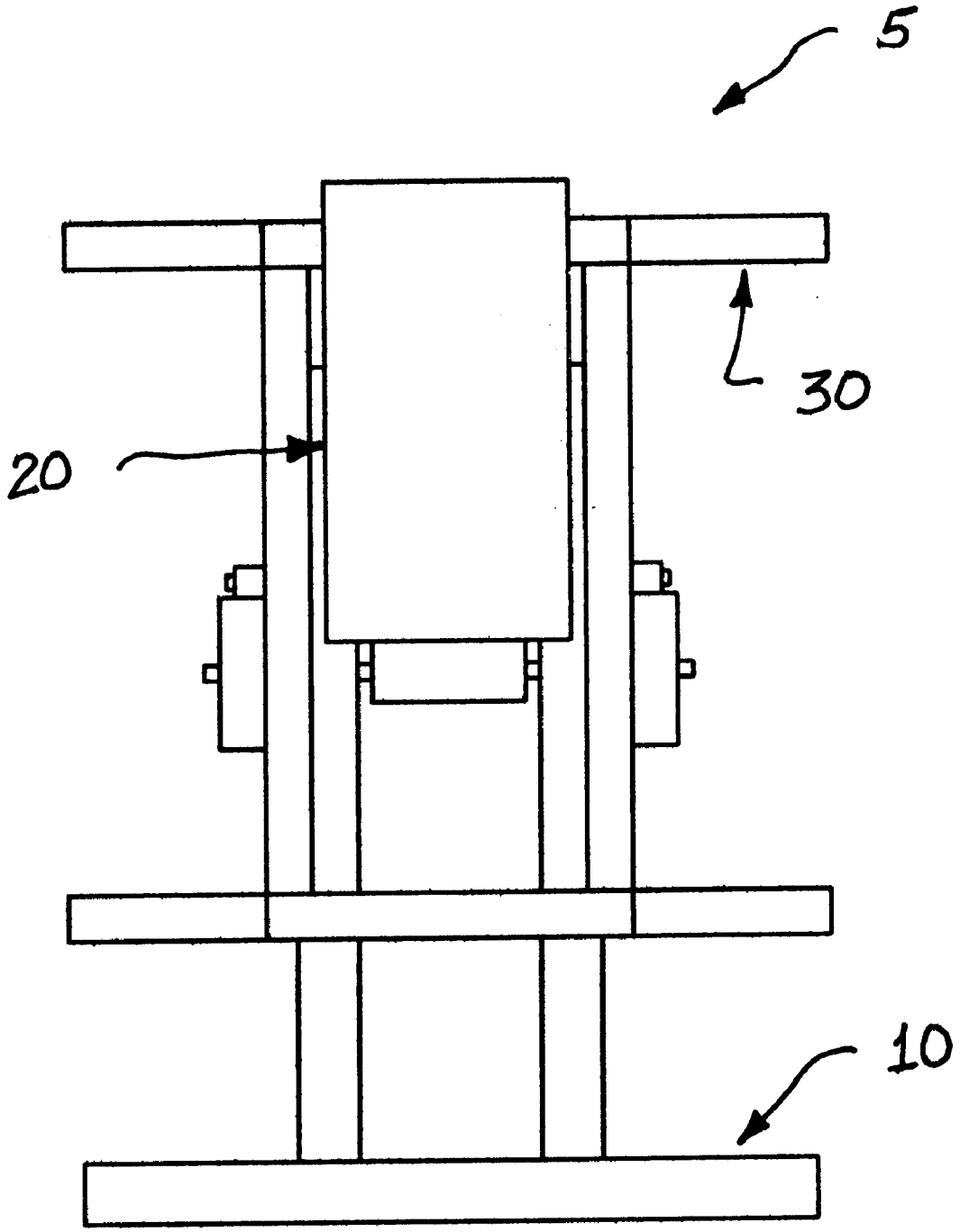
FIG. 1C is a side view of the pivoting uplift apparatus.

As best can be seen by references to the drawings, and in particular to FIGS. 1A–1C, the pivoting uplift apparatus that forms the basis of the present invention is designated generally by the reference numeral 5, and includes a frame structure means 10, a user support means 20, and a user engagement means 30. The user support means 20 pivotally mounts upon frame structure means 10, while the user engagement means 30 pivotally mounts upon user support means 20.

Figure 2A:
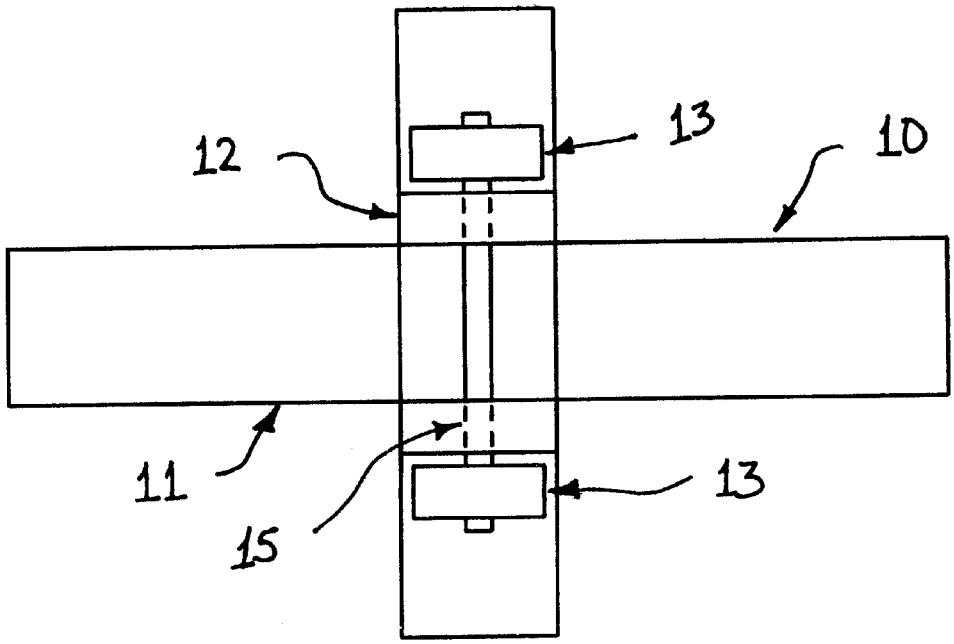
FIG. 2A is a top view of the frame structure means of the pivoting uplift apparatus.
Figure 2B:
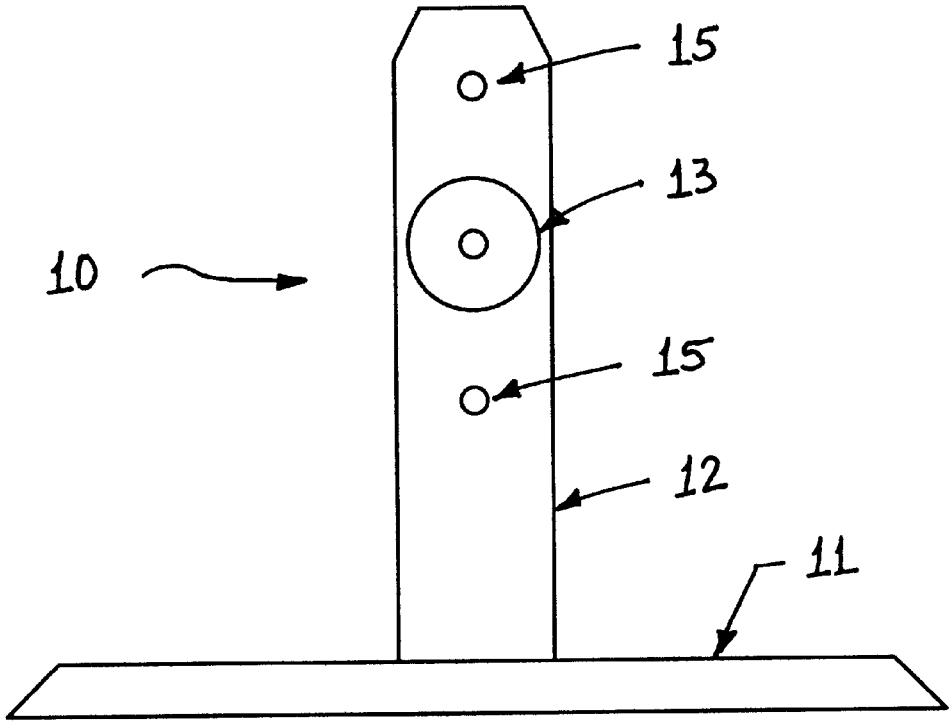
FIG. 2B is a front view of the frame structure means of the pivoting uplift apparatus.
Figure 2C:
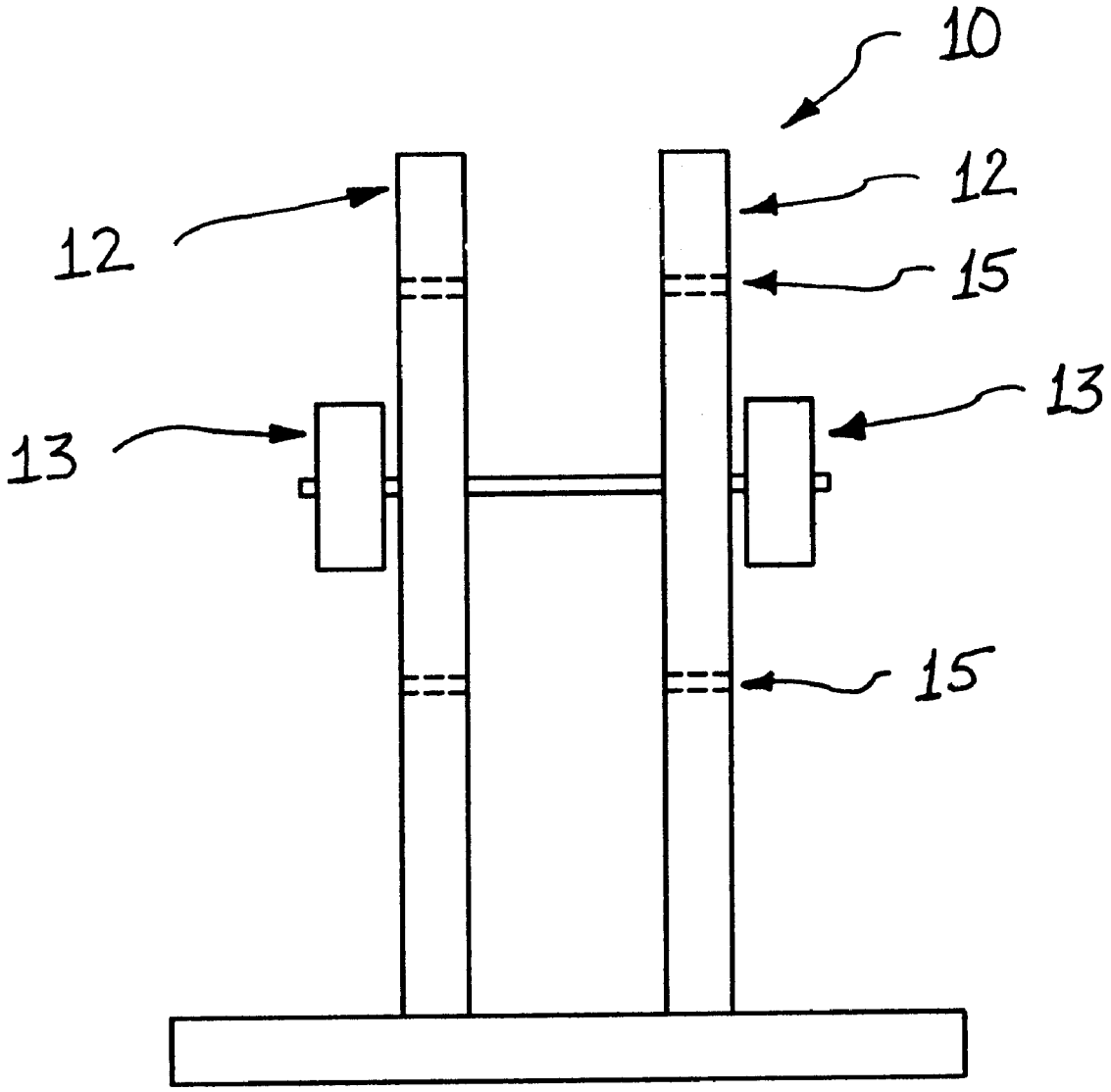
FIG. 2C is a side view of the frame structure means of the pivoting uplift apparatus.

As may be seen in FIGS. 2A–2C, the frame structure means 10 comprises a base member 11, at least one support member 12, at least one main curved member 13, and frame openings 15. The support member 12 is an upwardly extending structure, supported at its lower end by base member 11. Main curved member 13 may rotatably mount to support member 11 through one of the frame openings 15 via a bolt, pin, or the like. It could also be rigidly mounted, but the rotatable mounting is preferred.

Figure 3A:
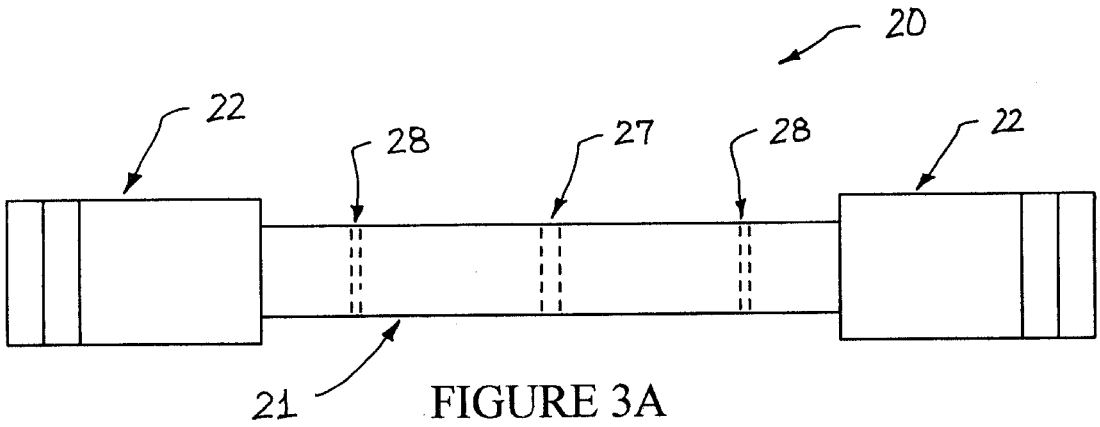
FIG. 3A is a top view of the user support means of the pivoting uplift apparatus.
Figure 3B:
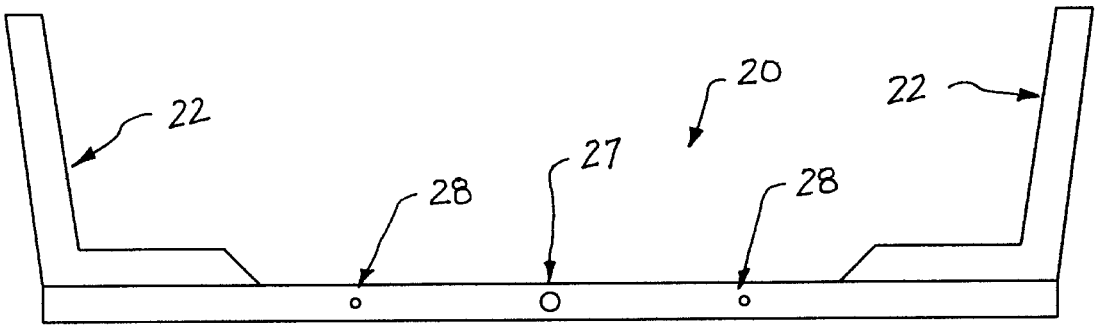
FIG. 3B is a front view of the user support means of the pivoting uplift apparatus.
Figure 3C:
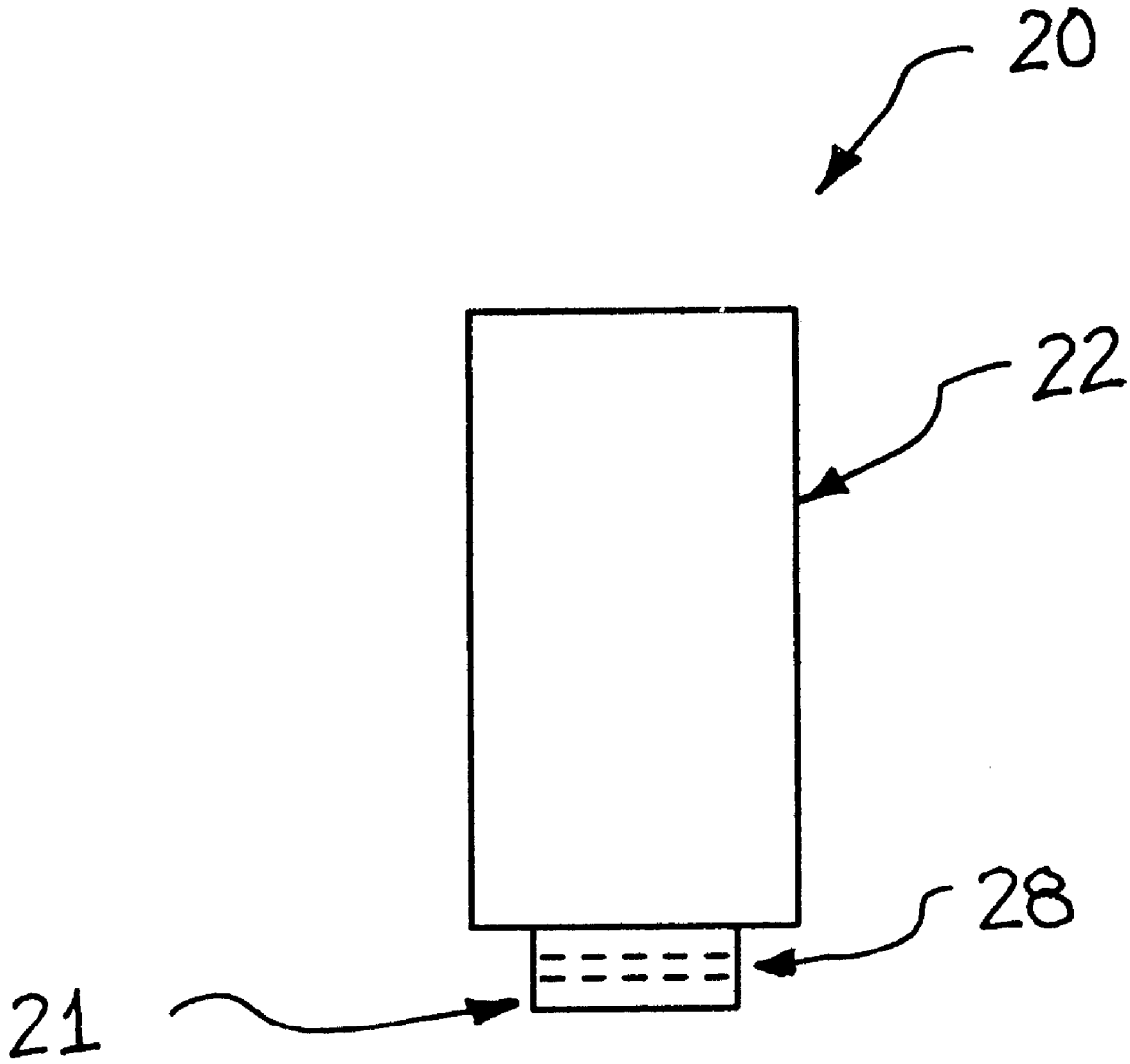
FIG. 3C is a side view of the user support means of the pivoting uplift apparatus.

As may be seen in FIGS. 3A–3C, user support means 20 comprises at least one main lever member 21, seat members 22, support openings 27, and engagement openings 28. Main lever member 21 is a generally horizontal structure having a seat member 22 rigidly mounted at opposite ends. The main lever member 21 pivotally mounts to the support member 12 of frame structure means 10 through support openings 27 of main lever member 21, and frame opening 15 of support member 12. As seen, in the preferred embodiment, the bolt or pin used to mount main curved member 13 to support member 12 is also used to pivotally mount main lever member 21 to support member 12.

Figure 4A:
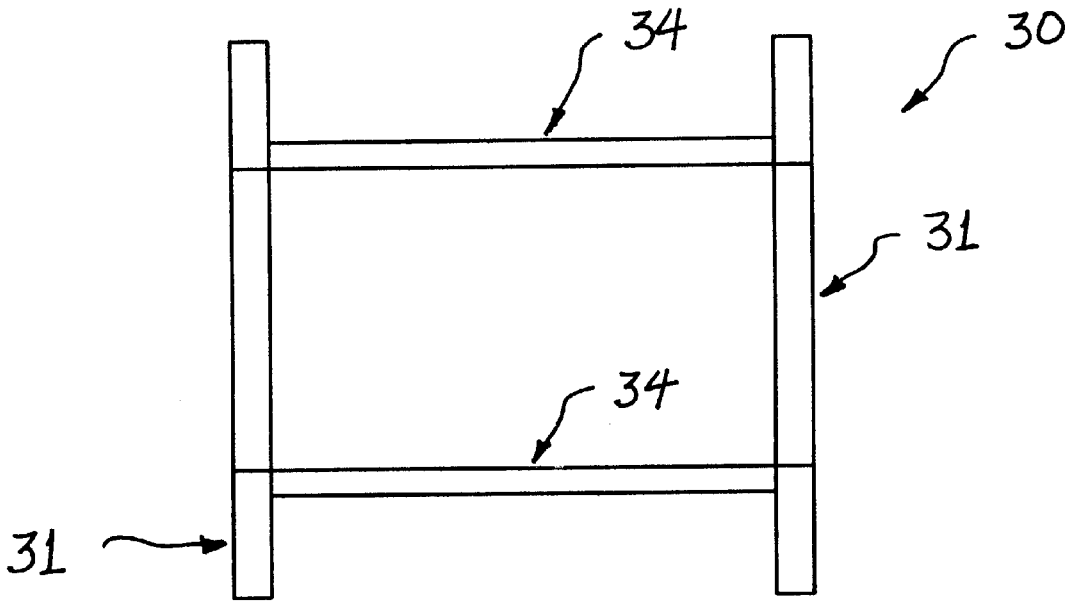
FIG. 4A is a top view of the user engagement means of the pivoting uplift apparatus.
Figure 4B:
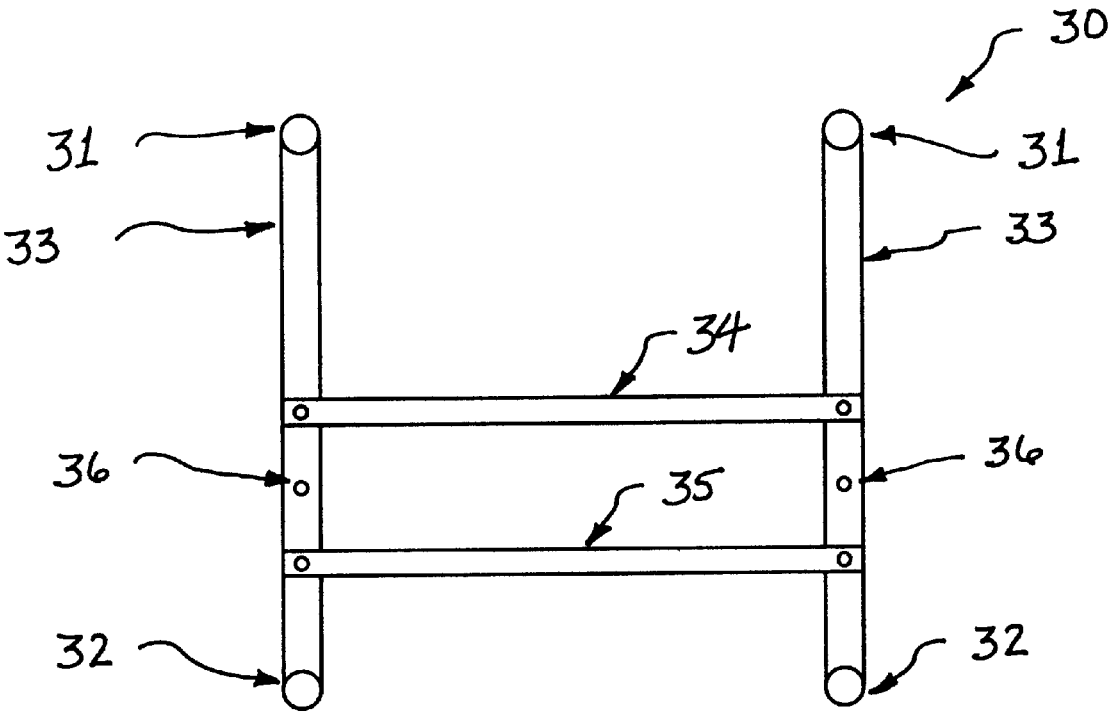
FIG. 4B is a front view of the user engagement means of the pivoting uplift apparatus.
Figure 4C:
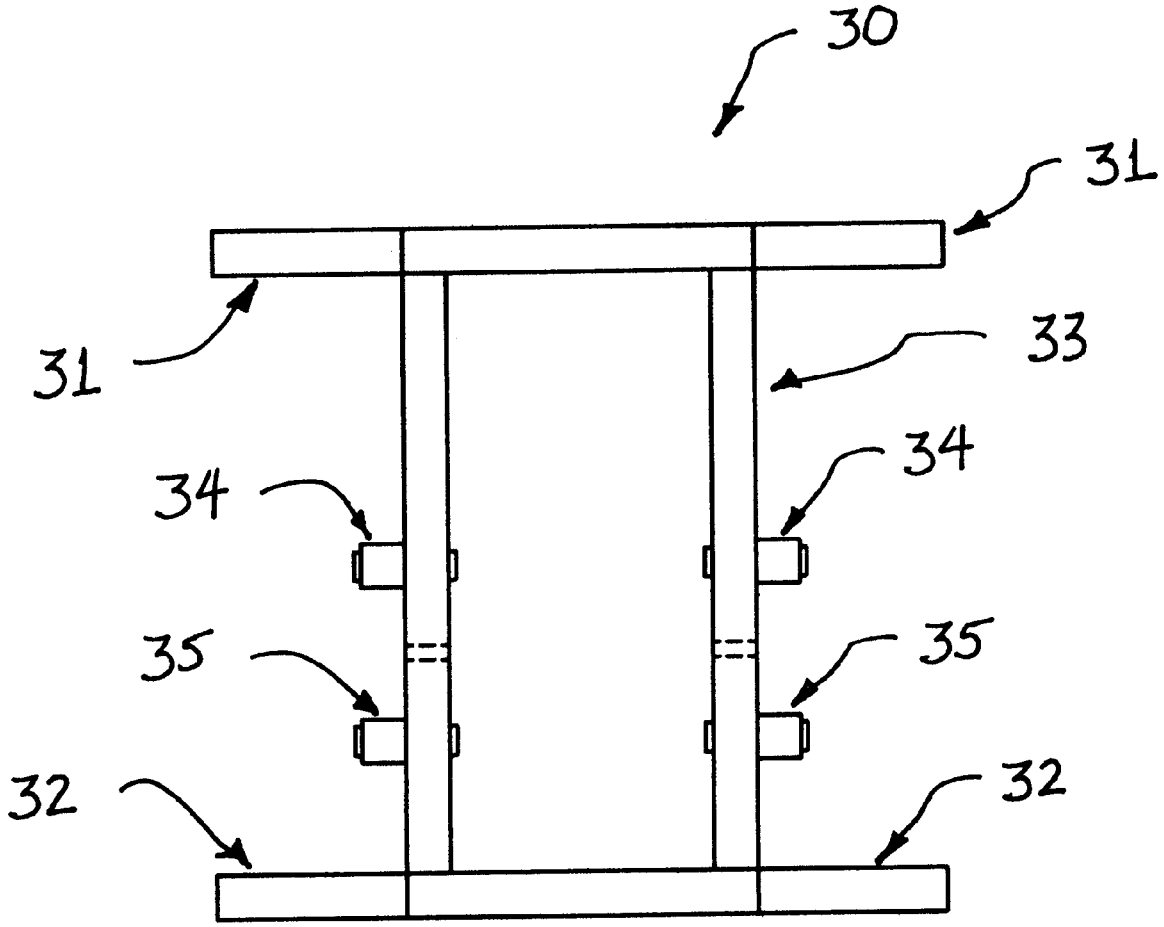
FIG. 4C is a side view of the user engagement means of the pivoting uplift apparatus.

As may be seen in FIGS. 4A–4C, user engagement means 30 comprises at least two rocker members 31 pivotally mounted to main lever member 21 through engagement openings 28. Each rocker member 31 is an upwardly extending structure and may have an upper engagement member 32 mounted at or neat the top, and a lower engagement member 33 mounted at or near the bottom. Either the upper engagement member 32 or the lower engagement member 33 may be considered optional. Only one is needed for user engagement. The rocker members 31 are mounted on opposite ends of said main lever member 21. The upper ends of each rocker member 31 are pivotally connected together using upper connection members 34, while the lower ends of rocker members 31 are pivotally connected together using lower connection members 35. These connection members, along with main lever member 21, keep the rocker members 31 parallel to one another while the apparatus is in operation.

Figure 5A:
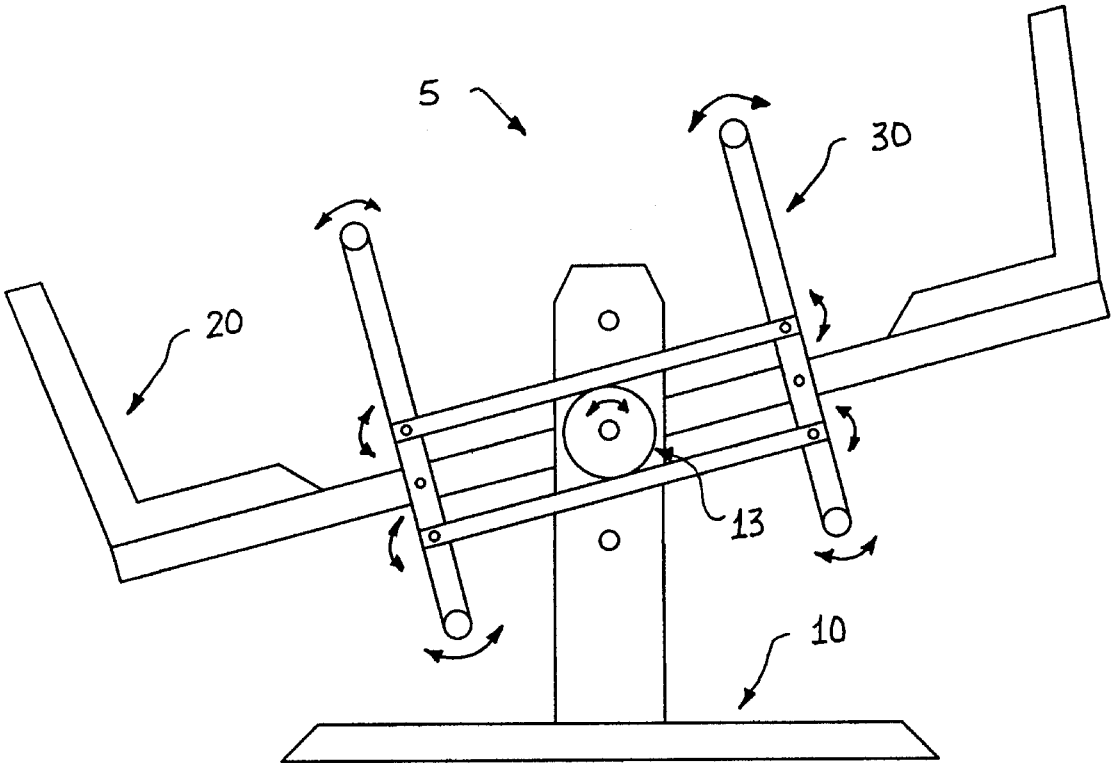
FIGS. 5A, 5B, and 5C are front views of the preferred embodiment for the pivoting uplift apparatus while in operation.
Figure 5B:
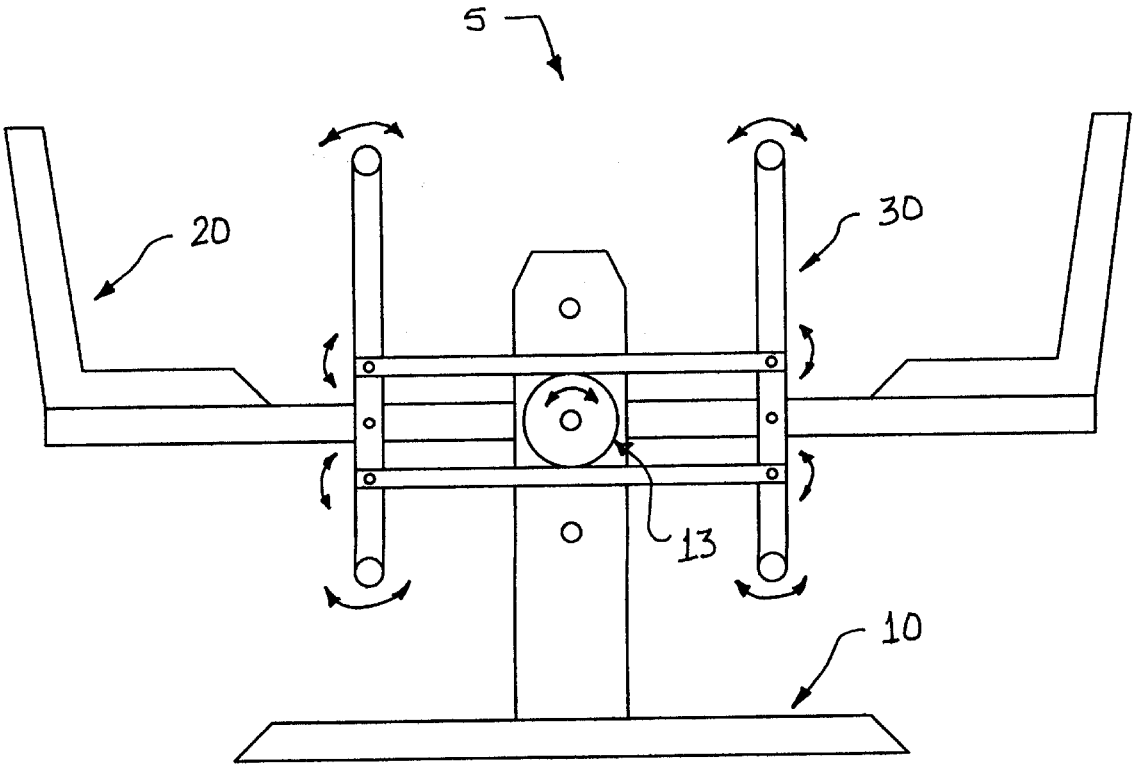
Figure 5C:
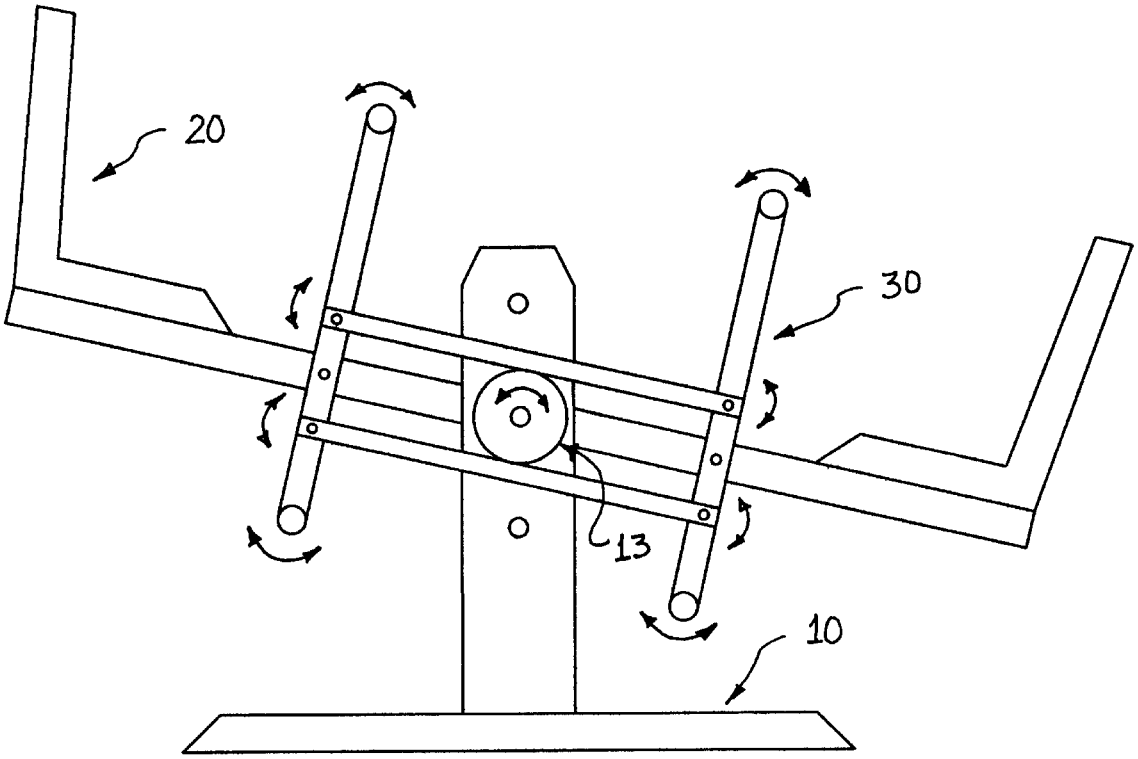

FIGS. 5A–5C demonstrate the preferred embodiment of the apparatus while in operation. As may be seen in these figures, moving the upper engagement member 32 in the forward direction and/or the lower engagement member 33 in the backward direction will cause the corresponding seat member 22, and thus the user, to pivot in the upward direction. Conversely, moving the upper engagement member 32 in the backward direction and/or the lower engagement member 33 in the forward direction will cause the corresponding seat member 22, and thus the user, to pivot downward. Motion in the upper engagement member 32 will normally be produced by the upper body of the user, i.e. arms and hands, while motion in the lower engagement member 33 will normally be produced by the lower body of the user, i.e. legs and feet. The apparatus may also be designed to utilize other parts of the body for movement.

The pivoting motion is produced when the upper connection member 34 engages main curved member 13. As upper connection member 34 is moved in one direction, the force exerted upward by main curved member 13 on upper connection member 34 will cause the end of main lever member 21, towards which the connection member moves, to pivot downward. In this configuration, lower connection member 35 is not necessarily required, but does assist somewhat in producing the pivoting motion, and also in keeping rocker members 31 generally parallel to one another. In this embodiment, rocker members 31 will remain generally perpendicular to main lever member 21.

Figure 6A:
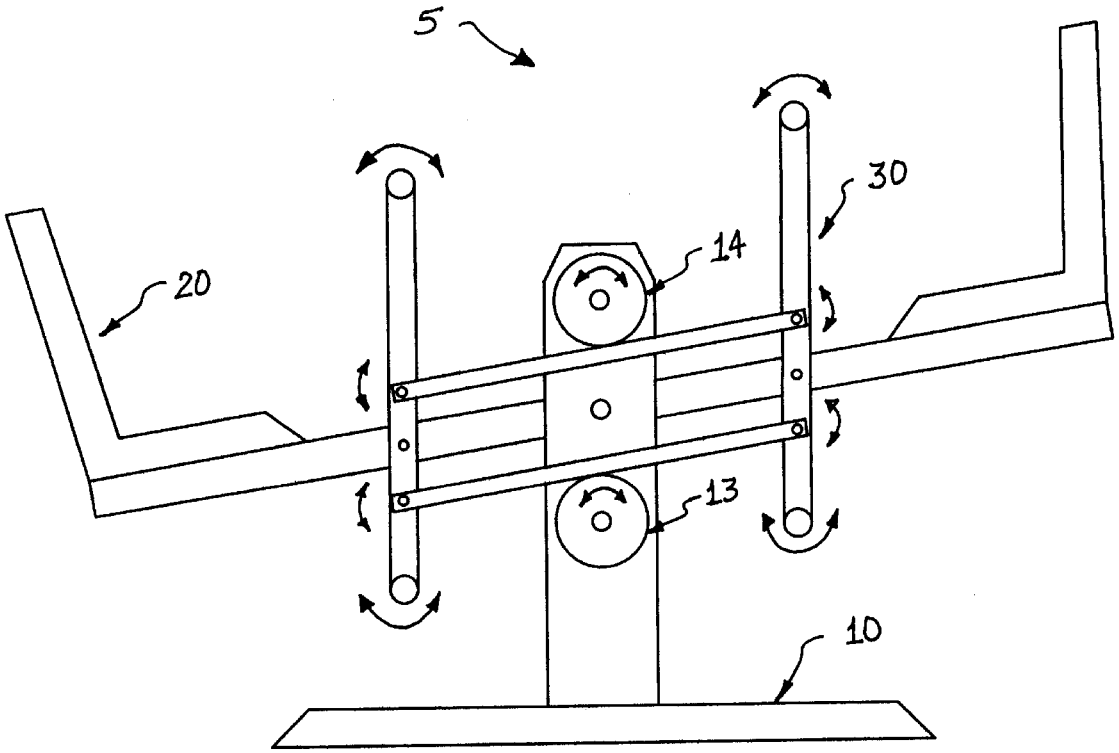
FIGS. 6A, 6B, and 6C are front views of a second embodiment for the pivoting uplift apparatus while in operation.
Figure 6B:
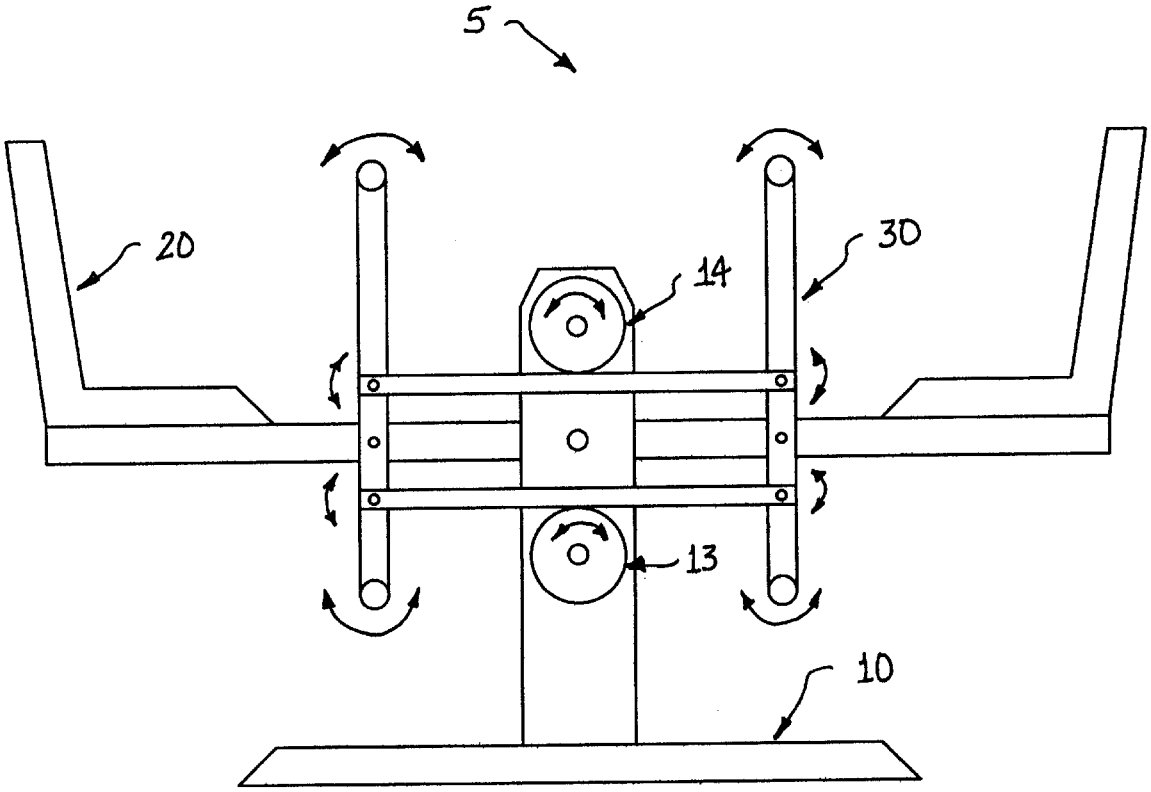
Figure 6C:
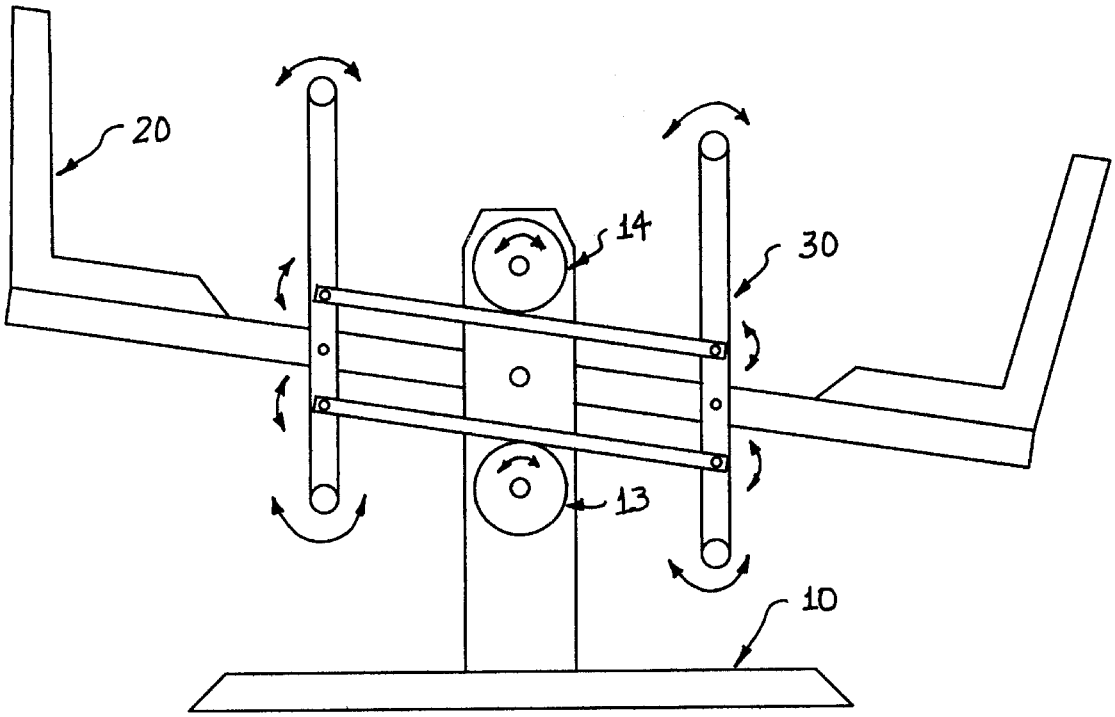

FIGS. 6A–6C demonstrate a second embodiment of the pivoting uplift apparatus. In this instance, main curved member 13 has been moved to a lower position, so that lower connection member 35 engages the upper part of curved member 13. This, in effect, causes an opposie motion from that shown and described for the preferred embodiment. Moving the upper engagement member 32 in the backward direction, and/or the lower engagement member 33 in the forward direction, causes the corresponding seat member 21 to pivot upward. Conversely, moving the upper engagement member 32 in the forward directions, and/or the lower engagement member 33 in the backward direction, causes the corresponding seat member 21, and thus the user, to move downward.

The pivoting motion is produced when the lower connection member 35 engages main curved member 13. As lower connection member 35 is moved in one direction, the force exerted upward by main curved member 13 on lower connection member 35 will cause the end of main lever member 21, towards which the connection member moves, to pivot downward. This motion is thus opposite from the motion in the preferred embodiment. In this instance, upper connection 32 is not necessarily required, but does assist in producing the pivoting motion. A secondary curved member 14 may be added to engage upper connection member 32, with upper engagement member 32 engaging the bottom part of secondary curved member 14. In this instance, secondary curved member 14 and upper connection member 32 keep the rocker members 31 generally parallel to one another, and generally upright.

Figure 7:
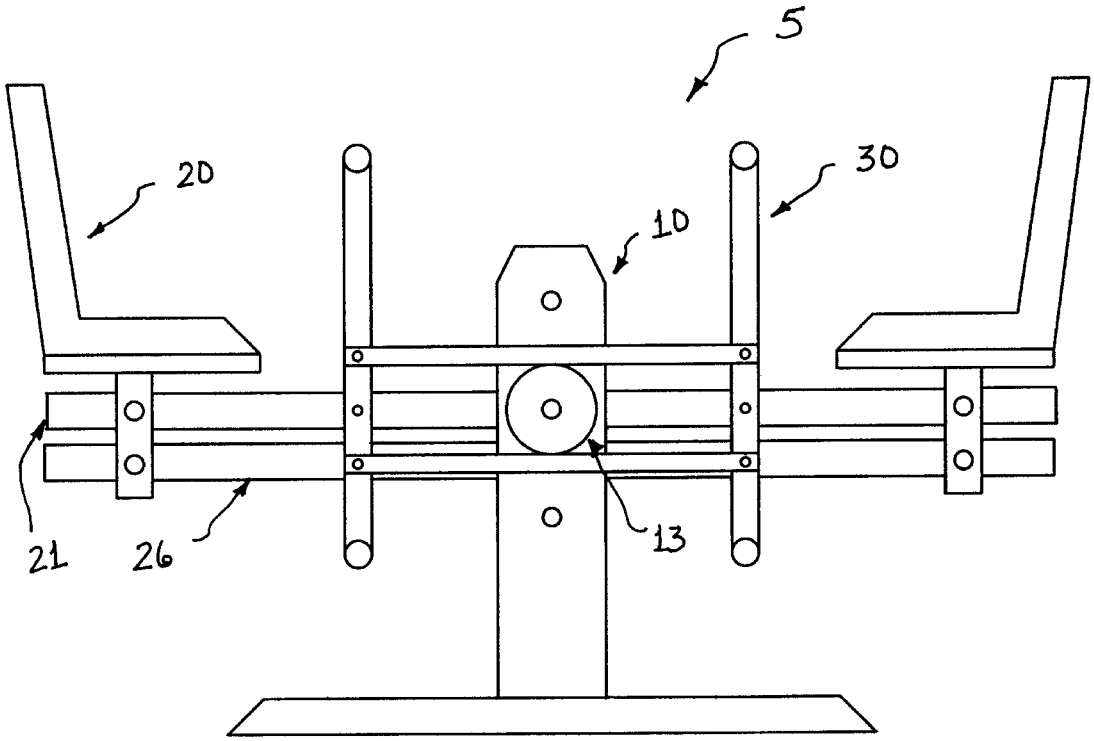
FIG. 7 is a front view of the pivoting uplift apparatus with the user support means utilizing a double crank assembly.

As may be seen in FIG. 7, a secondary lever member 26 may used in conjunction with main lever member 21 of the user support means 20. This secondary lever member 26 is also pivotally mounted to support member 12 of frame structure means 10. The seat members 22 may be pivotally mounted to both main lever member 21 and secondary lever member 26, so that the seats maintain a generally horizontal position during operation of the apparatus. This well-known double lever feature may be incorporated into either embodiment of the apparatus.

Figure 8:
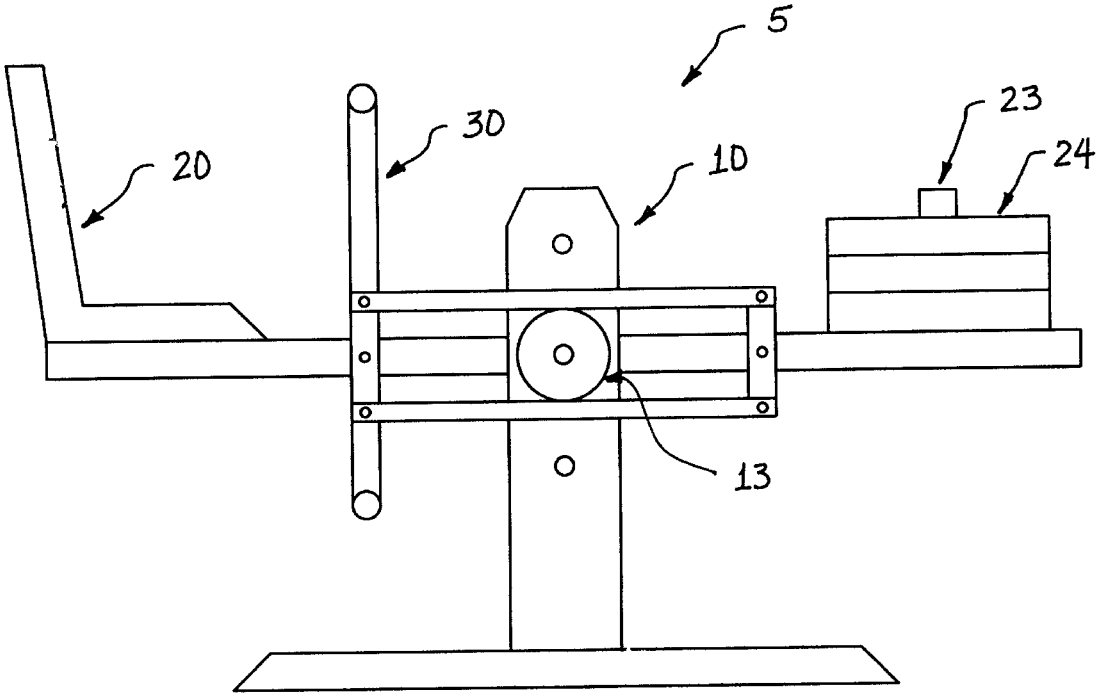
FIG. 8 is a front view of the pivoting uplift apparatus configured for a single user and also for an exercise machine.

FIG. 8 demonstates the apparatus while being used as a single user see-saw device, and/or as an exercise machine. As seen, there is only one seat member 22, one upper engagement member 32, and one lower engagement member 33. However, a second rocker member 31 is needed. An optional item is weight support member 23, which may be used to support weight members 24. Weights may be used not only when the apparatus is configured as an exercise machine, but also when it is configured for the single user see-saw to make operation easier. Again, these features may be incorporated into either embodiment of the apparatus.

Many variations of the pivoting uplift apparatus exist, along with the configurations described above. While it will be apparent that the embodiments of the invention herein is well calculated to fulfill the objects stated above, it will be appreciated that the invention is susceptible to modification, variation, and change without departing from the proper scope or fair meaning of the subjoined claims.

I claim:

1. A pivoting uplift apparatus comprising:

a frame structure means having a wheel rotatably mounted thereon;

a user support means pivotally mounted to said frame means;

a user engagement means pivotally mounted to said user support means and operatively engaging said wheel; whereby pivoting said user engagement means in the general forward and backward directions produces general upward and downward pivoting motion in said user support means.

2. The pivoting uplift apparatus as claimed in claim 1, said frame structure means further comprising:

a base;

at least one support member extending generally upward from said base, said wheel being mounted to said support member.

3. The pivoting uplift apparatus as claimed in claim 2, said user support means further comprising:

at least one generally horizontal lever member, said lever member being pivotally mounted on said support member of said frame structure means;

at least one seat member mounted to one end of said lever member.

4. The pivoting uplift apparatus as claimed in claim 3, said user engagement means comprising:

at least two rocker members pivotally mounted to said lever member of said user support means, said rocker members being pivotally mounted on opposite ends of said lever member;

at least one upper engagement member mounted to the top of one of said rocker members;

at least one connection member pivotally connecting said rocker members so that said rocker member remain generally parallel to one another, said connection member operatively engaging said curved member of said frame structure means; whereby moving said connection member backward and forward against said wheel of said frame structure means produces upward and downward movement of said lever member of said user support means.

5. The pivoting uplift apparatus as claimed in claim 3, said user engagement means further comprising at least one lower engagement member mounted to the bottom of one of said rocker members.

6. The pivoting uplift apparatus as claimed in claim 3 further comprising a weight support assembly mounted to one end of said lever member.

7. A pivoting uplift apparatus comprising:

a frame structure means comprising a base and at least one support member extending generally upward from said base and having a curved member mounted thereon;

a user support means pivotally mounted to said frame means to move in the general upward and downward directions; said user support means comprising at least one generally horizonal lever member pivotally mounted to said frame structure means; and at least one seat member mounted to said lever member;

a user engagement means pivotally mounted to said user support means to move in the general backward and forward directions, said user engagement means operatively engaging said frame structure means; said user engagement means comprising:

at least two rockers members pivotally mounted to said lever member of said user support means, said rocker members being pivotally mounted on opposite ends of said lever member;

at least one upper engagement member mounted near the top of one of said rocker members;

at least one connection member pivotally connecting said rocker members so that said rocker members remain generally parallel to one another, said connection members also operatively engaging said curved member of said frame structure means; whereby moving said connection member general backward and forward against said curved member of said frame structure means produces generally upward and downward movement of said lever member of said user support means.

8. The pivoting uplift apparatus as claimed in claim 7, said curved member being a wheel, said wheel being rotatably mounted to said support member.

9. The pivoting uplift apparatus as claimed in claim 7, said user engagement means further comprising at least one lower engagement member mounted to the bottom of one of said rocker members.

10. The pivoting uplift apparatus as claimed in claim 7 further comprising a weight support assembly mounted to one end of said lever member.

* * * * *

UNITED STATES PATENT AND TRADEMARK OFFICE

CERTIFICATE OF CORRECTION

PATENT NO. : 6,383,083 B1
DATED : May 7, 2002
INVENTOR(S) : Gary Johnston

It is certified that error appears in the above-identified patent and that said Letters Patent is hereby corrected as shown below:

Column 6,
Lines 9 and 10, "connection members" should be -- connection member --.

Signed and Sealed this

Fifth Day of November, 2002

*Attest:*

*Attesting Officer*

JAMES E. ROGAN
*Director of the United States Patent and Trademark Office*